US005603209A

United States Patent [19]

Knabel

[11] Patent Number: 5,603,209

[45] Date of Patent: Feb. 18, 1997

[54] BEARING ARRANGEMENT FOR AN OPEN-END SPINNING ROTOR

[75] Inventor: Manfred Knabel, Ingolstadt, Germany

[73] Assignee: Rieter Ingolstadt Spinnereimaschinenbau AG, Ingolstadt, Germany

[21] Appl. No.: 450,547

[22] Filed: May 25, 1995

[30] Foreign Application Priority Data

Sep. 17, 1994 [DE] Germany ..... 44 33 240.8

[51] Int. Cl.[6] ..... D01H 4/00

[52] U.S. Cl. ..... 57/406; 57/407

[58] Field of Search ..... 57/406, 407

[56] References Cited

U.S. PATENT DOCUMENTS

| | | | |
|---|---|---|---|
| 3,805,506 | 4/1974 | Stahlecker | 57/78 |
| 3,807,157 | 4/1974 | Stahlecker | 57/407 X |
| 3,877,212 | 4/1975 | Canzler | 57/100 |
| 4,105,265 | 8/1978 | Stahlecker | 384/536 |
| 4,186,548 | 2/1980 | Stahlecker | 57/406 |
| 4,703,616 | 11/1987 | Feuchter et al. | 57/406 X |
| 4,763,469 | 8/1988 | Stahlecker et al. | 57/406 X |
| 5,426,931 | 6/1995 | Beitzinger et al. | 57/406 |

FOREIGN PATENT DOCUMENTS

| | | | |
|---|---|---|---|
| 3811627 | 12/1988 | Germany | 57/406 |

OTHER PUBLICATIONS

Ru 14 Operating Manual, pp. A6–39–A6–46, Published Jul. 24, 1991.

*Primary Examiner*—William Stryjewski
*Attorney, Agent, or Firm*—Dority & Manning

[57] ABSTRACT

Bearing arrangement for an open-end spinning machine has a bearing block attached to bearing supports defined on the machine frame. A seat is defined in the bearing block for receipt of an axial bearing. An intermediate support structure member is removably attached to the bearing block and supporting ring bearings. The intermediate support structure is removable from the bearing block with the supporting ring bearings while the bearing block remains attached to the machine frame through bearing supports.

16 Claims, 7 Drawing Sheets

BEARING ARRANGEMENT FOR AN OPEN-END SPINNING ROTOR

BACKGROUND OF THE INVENTION

The instant application relates to a bearing arrangement for an open-end spinning rotor.

To equip the individual sections of the rotor spinning machine with a U-shaped support on the inside of which the bearing arrangement by means of supporting disks is installed is known from the rotor spinning machine RU14 of the firm Schubert & Salzer, now Rieter Ingolstadt, D-85046 Ingolstadt. The bearing block, which holds the supporting ring bearings and the axial bearing for the spinning rotor, is mounted on a supporting plate which in turn is screwed on the horizontal leg of the U-shaped support. For maintenance of the bearing, in particular for the replacement of the supporting rings, it is necessary to detach the bearing block from the supporting plate or the latter from the U-shaped support and to pull it out of the spinning machine under the tangential belt which drives the rotor. For this it is necessary to stop the tangential belt of the drive of the spinning rotor. The attachment of the supporting ring bearings on the bearing block is effected by means of a clamping device which reaches over the two supporting ring bearings and pushes them into the seat on the bearing block.

The disadvantage of such a bearing arrangement is that the maintenance and disassembly of the bearing arrangement, in particular the replacement of the supporting rings, is very expensive. After detaching the attachments of the supporting plate or those of the bearing block, the bearing must be lifted out of the U-shaped support past the tangential belt, together with the supporting rings and the axial bearing on the bearing block.

In order to replace the supporting rings however, not only the entire bearing block must be taken out of the spinning machine and replaced, but the type of attachment of the bearing block and of the supporting plate on the U-shaped support make it furthermore impossible to move the bearing block downwards, so that it cannot be guided out below the tangential belt. Due to the fact that contact with the tangential belt is unavoidable when taking out the bearing, it is indispensable to stop at least one half of the spinning machine so that the drive belt can be pushed aside. Due to the stoppage of the machine, a great production loss is incurred.

DE-A 43 25 304 discloses a bearing arrangement for an open-end spinning rotor in which the supporting ring bearings have special attachments by which they are attached to the seats on the bearing block. To replace the supporting rings, these attachments can be removed from the bearing block. In another embodiment, the bearing block supports only the supporting rings, while the axial bearing is mounted on an extra bearing support, independently of the bearing block. In the first instance the disadvantage exists that removal of the supporting rings is possible only from below the bearing arrangement. In the other case, the alignment of the axial bearing with the supporting rings requires great manufacturing precision as well as very careful assembly. Regular inspection of the alignment of the axial bearing with the supporting rings seems to be unavoidable.

OBJECTS AND SUMMARY OF THE INVENTION

It is a principal object of the instant invention to design a bearing arrangement for an open-end spinning rotor in such a manner that the disadvantages of the state of the art are avoided and the bearing can be serviced easily and replacement of the supporting rings is made rapid, easy and safe, whereby this is to be carried out also without having to stop the driving means or having to remove it from the bearing arrangement. Additional objects and advantages of the invention will be set forth in part in the following description, or may be obvious from the description, or may be learned through practice of the invention.

The design of the bearing arrangement according to the invention makes it possible for all supporting rings to be removed at the same time, rapidly and safely. The replacement of the supporting rings can be carried out from the front, i.e. from the normal access side of the spinning machine. A replacement of the supporting disks is possible during operation of the spinning machine, i.e. without having to deactivate the driving means of the spinning rotor. Thanks to the design of the bearing arrangement according to the invention, sufficient room is provided for the replacement of the supporting rings during operation and the supporting rings can be replaced easily in their bearing arrangement even though the driving means continues to run without endangerment of the operator. The supporting rings can be handled here without moving the bearing block. By means of the intermediate support, the supporting rings are combined practically into one compact unit which can be guided easily and safely past the driving means and out of the bearing. The two pairs of supporting rings are grasped at the same time by means of the intermediate support so that both pairs can be removed from the bearing arrangement and replaced at the same time and can be re-installed in the same manner. The exchange can be especially rapid so that the stoppage time of the serviced spinning station of the spinning machine is very short. The intermediate support furthermore facilitates the utilization of an assembly tool since the latter is able to attack easily and safely at the intermediate support so that both supporting ring bearings with their appertaining supporting rings can be grasped at the same time. New adjustment of newly installed supporting rings relative to the other components of the spinning machine is advantageously not required since the bearing block remains in the bearing arrangement. A bearing block adjusted once on the machine practically never requires removal. Thereby expensive and time consuming adjustments can be omitted. It is a special advantage of the bearing according to the invention that the same intermediate support need not be inserted again on the bearing block for the replacement of the supporting rings. Instead, a different intermediate support equipped with new supporting rings can be installed in the bearing arrangement immediately after removal of the intermediate support, because the embodiment of the bearing according to the invention easily ensures that always the same installation conditions exist without great expense for fabrication, even when different intermediate supports are used on a bearing block. The intermediate support ensures precise allocation of the supporting rings, e.g. to the axial bearing and also to the other components of the spinning machine. The entire assembly has the special advantage that the exchange can be carried out very rapidly. The utilization of a new intermediate support in the bearing requires practically no adjustments by the operator, nor any other additional measures. The maintenance of the spinning station can be carried out advantageously by replacing only one component of the bearing arrangement without requiring the removal or replacement of the entire bearing block.

In an advantageous further development of the invention, the bearing block is provided with braces which extend axially relative to the supporting ring bearing, i.e. parallel with it and are provided with the seat of the axial bearing. This design of the bearing arrangement advantageously makes it possible to design the bearing block so as to save space and so that the intermediate support can be attached easily to the bearing block and is easily accessible. In addition, it has the further advantage that the intermediate support can be of simple design and can be easily connected to the baring block thanks to this design of the bearing arrangement.

In another advantageous further development of the invention it is proposed that the braces be of an axial length which is approximately equal to the length of the supporting ring axles and that there be no connection between them. As an advantageous result, the accessibility of the bearing arrangement is very good, e.g. for maintenance purposes. It is especially advantageous here to keep the distance between the braces so large that it is approximately equal to twice the diameter of the supporting rings, making it possible to adapt the distance between the braces to the size of the supporting rings so that the latter can be handled more easily and so that the accessibility of the bearing arrangement is sufficiently easy. The advantageous design of the bearing arrangement with a free space safely ensures that the intermediate support with the supporting rings can be handled sufficiently within the bearing arrangement during removal so that the replacement of the supporting rings during operation of the driving means, e.g. of a tangential belt or a drive wheel, is possible, without any danger to the maintenance personnel. The intermediate support can be shifted into the free space together with the supporting rings once the intermediate support has been detached from the bearing block so that a large safety distance is ensured between the supporting rings and the driving means during replacement of the supporting rings. The free space is created advantageously by designing the bearing, in particular the bearing block, so that braces or connections such as bearing elements of the bearing block are moved out of this area and below the intermediate support. The free space is advantageously designed so that it is able to receive at least the rear supporting rings, i.e. those supporting disks which are towards the axial bearing when handling the intermediate support, so that the supporting rings can be placed below the tangential belt. From there they can be removed from the bearing arrangement without coming into contact with the driving means.

The embodiment of the bearing, in which a separating plane in which the bearing block is separated from the intermediate support, is formed between the intermediate support and the bearing block is especially advantageous, and in which the separating plane extends substantially perpendicular to the axes of the supporting ring bearing. This makes it possible to move the intermediate support in the direction of the operator, i.e. in the removal direction after detaching the attachment. The advantageous placement of the separating plane between the planes in which the supporting rings towards the axial bearing lie and those planes in which the supporting rings away from the axial bearing lie is achieved in that the separating plane is essentially located in the center of gravity of the intermediate support. This results in a secure connection between the bearing block and the intermediate support, while ensuring at the same time that the attachments, e.g. screws, are easily accessible. Thanks to the especially advantageous design of the bearing arrangement, whereby the intermediate support can be shifted essentially horizontally, it is possible to simply loosen the attachments without having to remove them in order to remove the intermediate support from the bearing arrangement. In addition, the result is that the intermediate support can be handled within the bearing arrangement so that it can be placed in a position from which it can be removed easily and safely from the bearing arrangement. In the additional advantageous embodiment in which the intermediate support can be shifted in a vertical direction, the same advantageous effects as described above are achieved, whereby it is especially advantageous to design the intermediate support so that it can be shifted in both directions of the bearing arrangement.

To special advantage, the intermediate support is provided with fitting surfaces or stops whereby the adjustment of the exchanged or serviced intermediate support following its installation can be simplified or whereby the adjustment can be omitted. It is especially advantageous if the bearing block is also provided with such fitting surfaces or stops. In another especially advantageous embodiment, the fitting surfaces or stops of the intermediate support and the bearing block are placed in at least two different planes, so that the adjustment in at least these planes is achieved automatically by inserting the intermediate support into the bearing block. It is especially advantageous for the fitting surface or the stops to be placed in planes that are essentially perpendicular to each other, so that an adjustment after re-installation of the intermediate support is achieved automatically by attachment by means of the attaching devices. The design of the fitting surfaces or stops is especially advantageous if the intermediate stop can be moved nevertheless in a horizontal direction as well as in a vertical direction downward to the bearing block. This makes it possible to use also a free space below the driving means to remove the intermediate support for example, in that the intermediate support can be brought without any further measures into this free space. This can be achieved advantageously by designing one of the fitting surfaces so that the fitting surface is separated from its counter surface, e.g. by shifting the intermediate support in the separating plane, so that a vertical movement is then possible.

In an especially advantageous further development of the invention, the intermediate support is installed on the bearing block independently of the axial bearing. This ensures that only the component which has to be serviced can be removed from the bearing arrangement. In the present case the axial bearing remains in the bearing arrangement so that its new adjustment following maintenance is omitted. The intermediate bearing is advantageously provided with one or more extensions for an assembly implement so that it can be grasped and handled especially safely by the operator. The extensions are advantageously provided with notches, ridges or bores with which a snap or bayonet mount for example can interact.

DETAILED DESCRIPTION OF THE PREFERRED EMBODIMENTS

Figure 1:
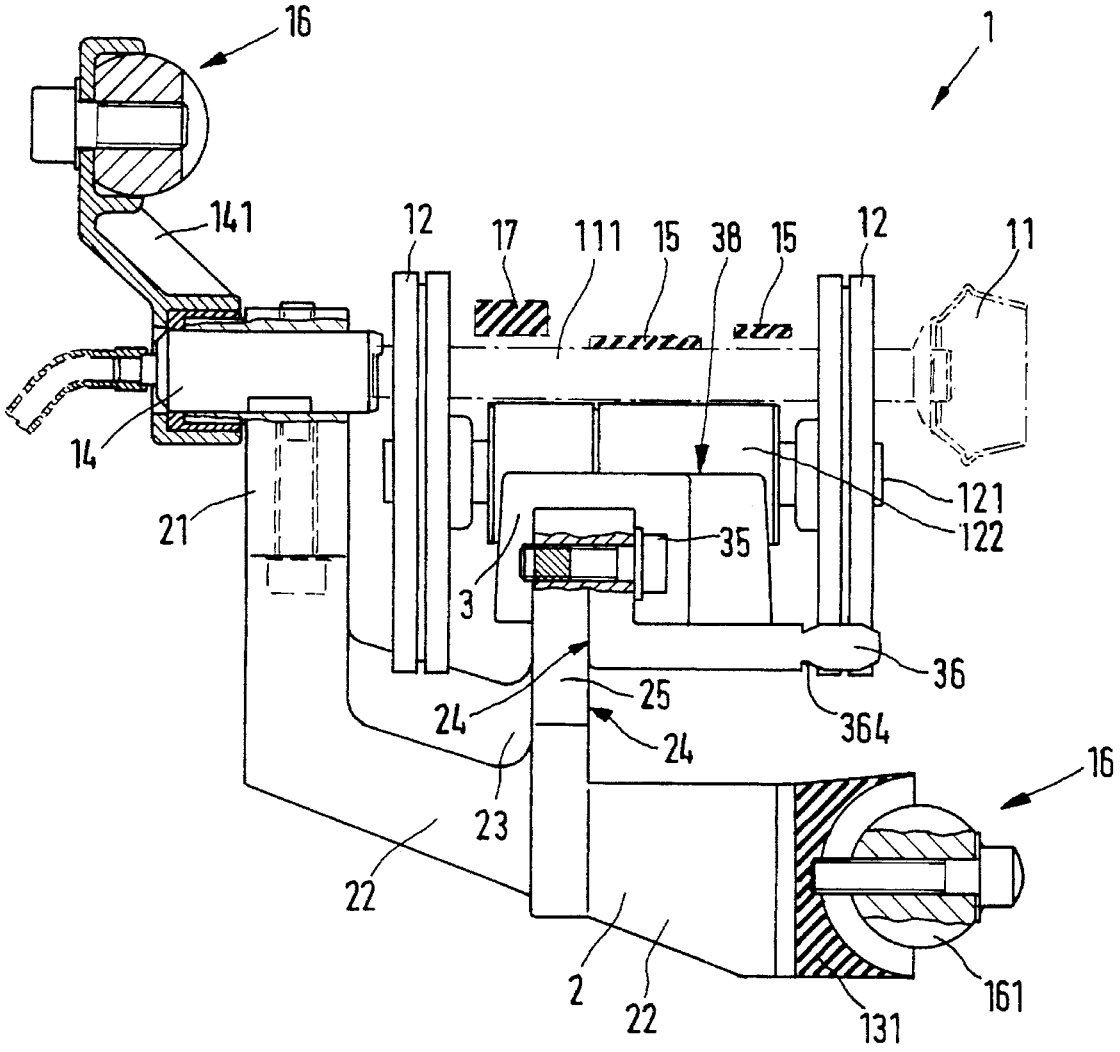
FIG. 1 shows a side view of the bearing arrangement according to the invention.

Reference will now be made in detail to the presently preferred embodiments of the invention, one or more examples of which are illustrated in the drawings. Each example is provided by way of explanation of the invention, and not as a limitation of the invention. In fact, it will be apparent to those skilled in the art that various modifications and variations can be made in the present invention without departing from the scope or spirit of the invention. Additionally, the numbering of components is consistent throughout the description and drawings, with the same components having the same number.

The bearing arrangement 1 according to the invention is shown in FIG. 1. in a side view. The bearing arrangement 1 essentially consists of a bearing block 2, an intermediate support 3 attached to it, a seat 21 for the axial bearing 14, supporting rings 12 for the radial support of the shaft 111 of the spinning rotor 11, driving means 15 which are made here in the form of tangential belts as well as of an axial bearing 14 for the axial support of the spinning rotor 11. The bearing block 2 is screwed to a bearing support 161 of the machine frame 16. To dampen oscillations, the bearing block 2 is provided with a damping element 131. The intermediate support 3 has 2 seats 38 by means of which two supporting ring bearings 122 are mounted on the intermediate support 3. Each of the supporting ring bearings 122 supports a shaft 121 (supporting ring axle) at each end of which a supporting ring 12 is installed. The four supporting rings 12 form two nips in a known manner in which the shaft 111 is supported radially. In addition to the driving means, 15 which in this case are made in the form of tangential belts, whereby two different rotor speeds can be obtained by means of the two shown driving means 15, a brake 17 which can be presented to the shaft 111 is also shown. The axial bearing 14 is held in the seat 21 by means of a clamping arrangement. The axial bearing 14 bears via support 141 for damping purposes on the machine frame 16. The intermediate support 3 is screwed by means of two attachment devices 35 to the holding devices 25 of the bearing block 2. Between the bearing block 2 or the holding devices 25 and the intermediate support 3 is the separating plane 24 in which essentially the bearing block 2 and the intermediate support 3 come into contact with each other.

The bearing block 2 is provided with the braces 22 which are mounted via seat 21 for the axial bearing 14. The braces 22 are essentially components of the bearing block 2. They reach from the attachment holding the bearing block 2 on the bearing support 161 to the area where the axial bearing 14 is received, and they support the holding devices 25 on which the intermediate support 3 is attached. The braces 22 extend parallel to the axles 121 of the supporting ring bearings 122, i.e. in the axial direction. In the area of the bearing block below the intermediate support 3, the bearing arrangement has a free space 23 which is sized so that for the purpose of disassembly of the intermediate support 3, at least the supporting rings 12 towards the axial bearing 14 can be pushed into it or lowered into it (see FIG. 2) so that the intermediate support together with the supporting rings can be taken out of the bearing arrangement 1 easily and without danger. In the example of an embodiment of the invention shown in FIG. 1 the required size of the free space is essentially given by the distance between the braces 22. This can be achieved of course by having the braces extend further below the intermediate support. However this usually requires an excessive height of the bearing arrangement. For the purpose of facilitating disassembly, the intermediate support 3 is provided with extensions 36 for attachment of an assembly implement. The extensions 36 extend axially into the area of the pair of supporting rings away from the axial bearing for easier access.

Figure 2:
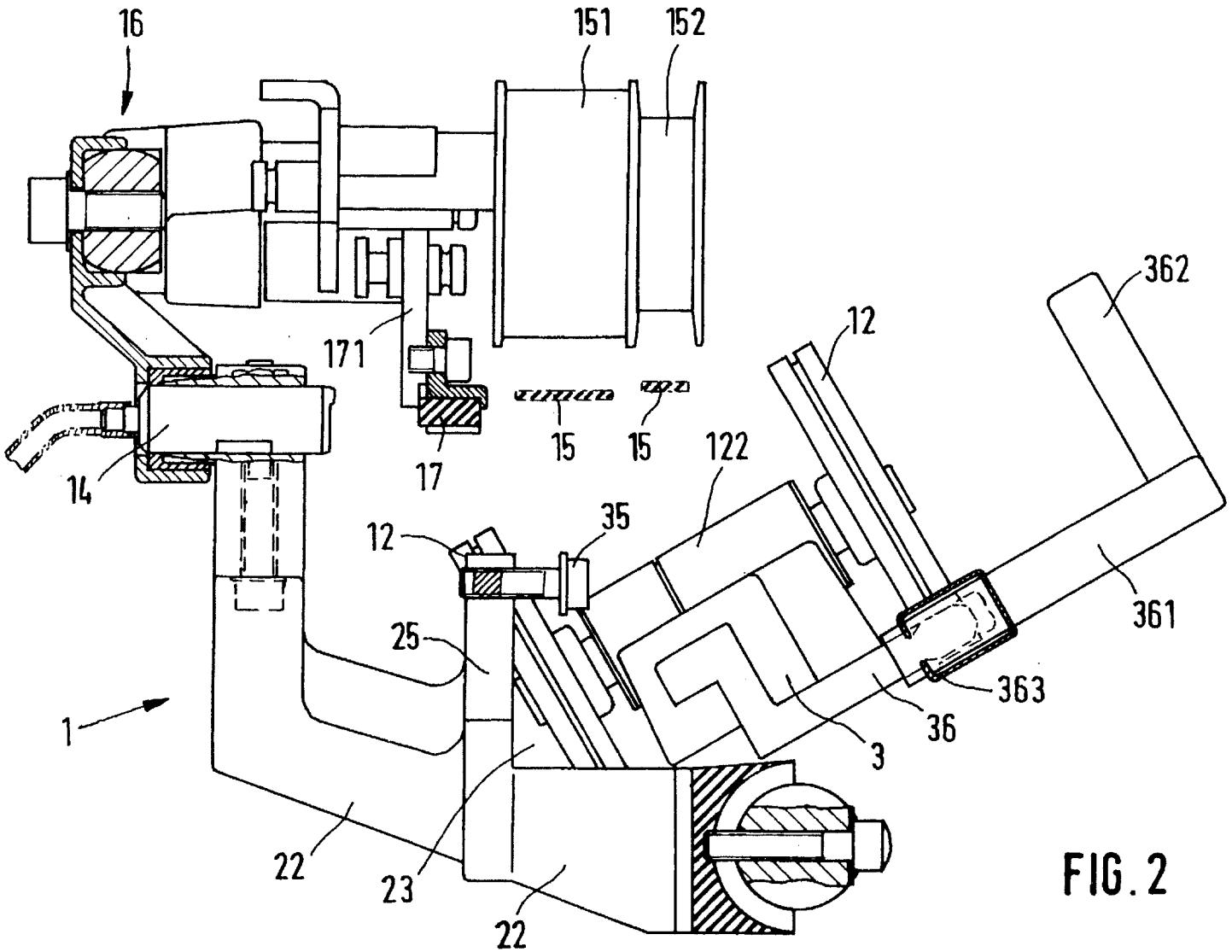
FIG. 2 shows a bearing arrangement according to FIG. 1 in its state during the removal of the intermediate support.

FIG. 2 shows the position of the intermediate support 3 as it is being exchanged in bearing arrangement 1. The supporting rings 12, of which only one is visible since the drawing is a side view, are lowered into the free space 23 so that they are at a great distance from the driving means 15. This makes it possible to remove them from the bearing arrangement 1 without touching the driving means 15. The removal of the supporting rings is therefore possible without stopping the driving means 15.

To remove the intermediate support, the screws used as attachments 35 are loosened without unscrewing them completely out of the thread. The intermediate support 3 can then be shifted in the separating plane 24 in the direction of the viewer of FIG. 1. This is made possible by the open oblong openings 32 (see FIG. 6). The intermediate support 3 is then shifted down into the free space 23. The intermediate support can be tilted in the free space 23, as shown in FIG. 2, as well as be shifted away from the axial bearing 14 and can be taken out of the bearing arrangement 1. In order to make this shifting possible, the intermediate support itself, as well as the fitting surfaces (see also description of FIGS. 3 and 6 to 9) and the bearing block, are designed accordingly.

At the extensions 36 of the intermediate support 3, an assembly implement 361 is attached with handle 362 by means of which the intermediate support 3 can be handled easily and safely by an operator during removal and installation. The assembly implement 361 is provided with elastic claws 363 by means of which it clips itself into the notches 364 of the extensions 36 (see FIG. 1). In addition to the drawing of FIG. 1, the pressure rollers 151 and 152 are also shown in FIG. 2, as well as the holding device 171 for the brake 17. The appertaining driving means 15 are pressed in a known manner against the shaft 111 by means of the pressure rollers 151 and 152 so that force transmission may take place. To stop the spinning rotor 11, the brake 17 is pressed against the rotor shaft via rods which are not shown in detail and via the holding device 171.

Figure 3:
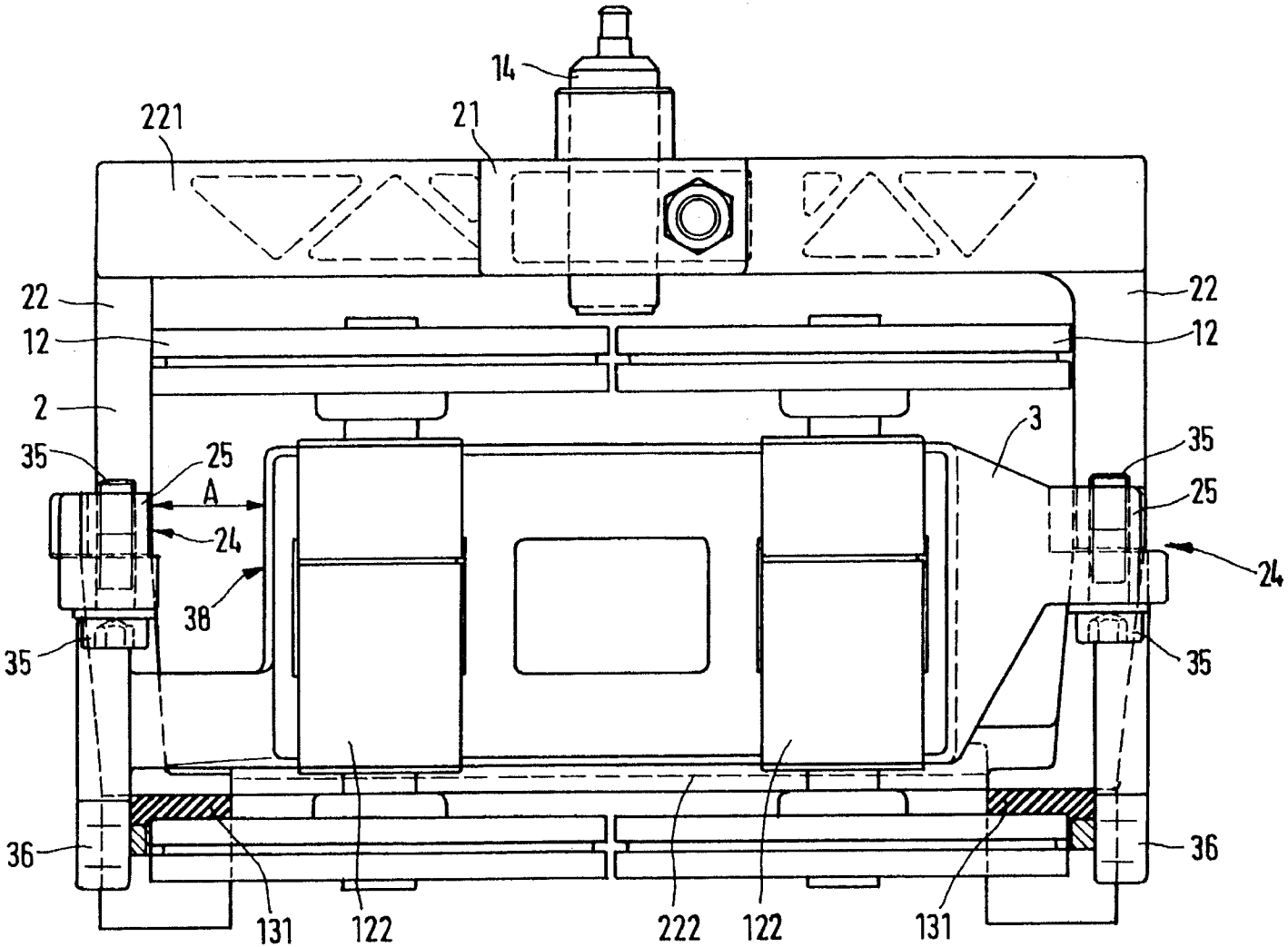
FIG. 3 shows a top view of the bearing arrangement according to the invention, e.g. without driving means.

FIG. 3 shows a top view of the bearing arrangement of FIG. 1 according to the invention, whereby driving means, brake, spinning rotor and the additional support 141 of the axial bearing 14 are not shown. Invisible edges are represented in the drawing of FIG. 3 in part by broken lines. It can be seen from FIG. 3 that the distance between the braces 22 extending axially is approximately double the diameter of the supporting rings 12. This makes it possible, if necessary, to lower the latter below the driving means 15 sufficiently so that the supporting rings 12 come into the area between the supporting rings 12 when replacing the supporting rings. Such a design of the distance between the braces 22 ensures that the bearing block 2 does not impose any limitations in manageability upon the supporting rings during replacement. Each of the axially extending braces 22 is provided with a connection 221 which extends in the area of the axial bearing 14 and with a connection 222 which are approximately perpendicular to the braces, but on the side away from the axial bearing 14. In addition to the two braces 22, the connections 221 and 222 have no other connections extending in the axial direction, just as the braces 22 extending axially have no connection between them other than the connections 221 and 222. One holding device 25 made in one piece with the brace 22 is installed on each of the axially extending braces. The intermediate support 3 is screwed on the holding devices 25. The connection 221 has the seat 21 of the axial bearing 14 and is made in one piece with this seat.

After detaching the attachments 35, the intermediate support 3 can be displaced within the separating plane 24 at a right angle to the axis 121 of the supporting ring bearings 122. In the present case the intermediate support 3 is designed so that a sufficient distance A exists between the holding devices 25 and the seat 38 of the left supporting ring bearing 122 that it can be displaced to the left within the separating plane without being limited by the bearing block 2 or the holding devices 25 in its mobility, before the intermediate support 3 is freed from the attachments 35. This makes it possible to separate the intermediate support 3 from the bearing block 2 and to remove it from the bearing arrangement 1 without removing the attachments 35 completely. It suffices to loosen the attachments, in this case the screws 35, sufficiently so that the intermediate support can be displaced in the separating plane 24. For that purpose, open elongated openings 32 are provided on the intermediate support (see also FIG. 6).

Figure 4:
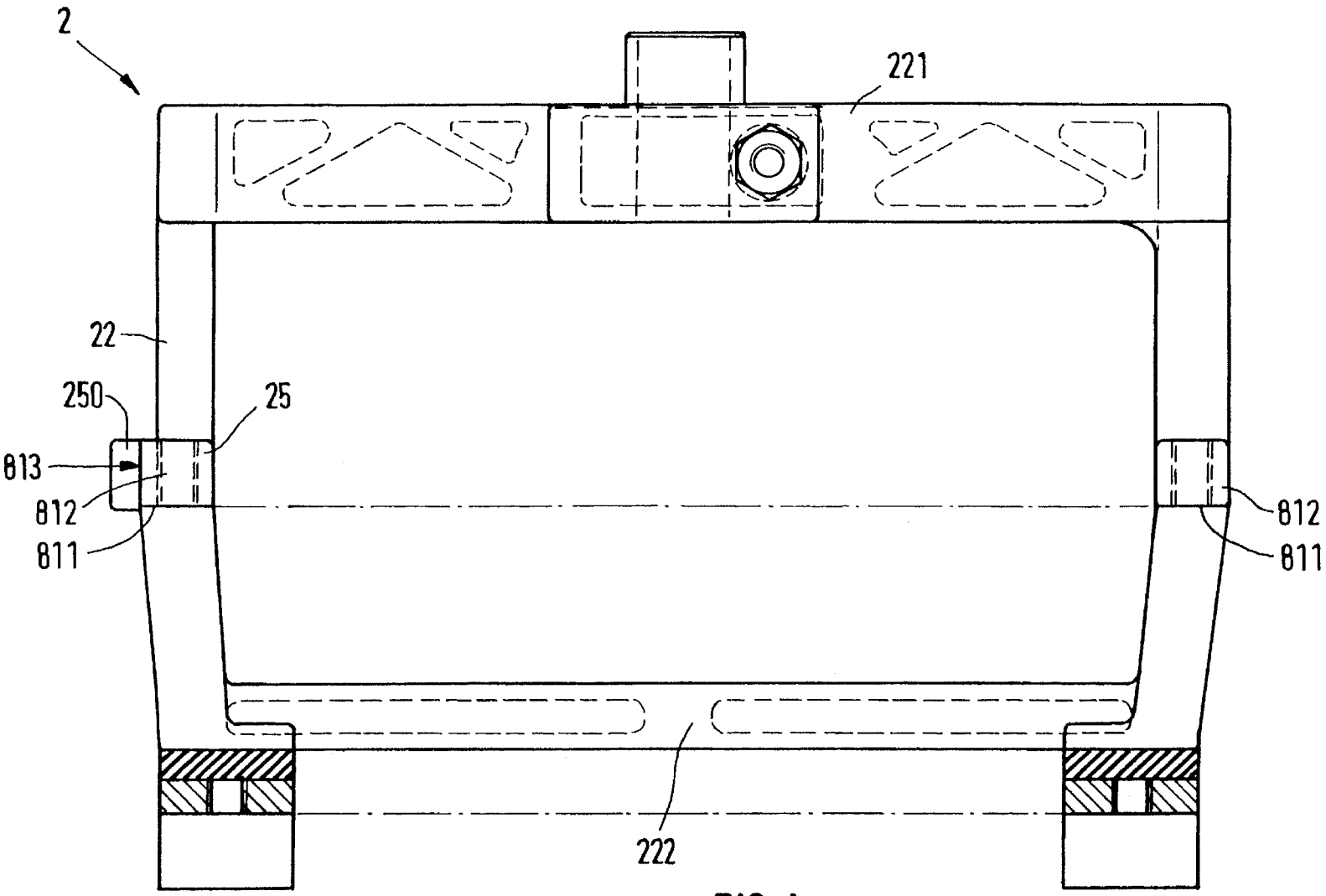
FIG. 4 shows a top view of the bearing block of FIG. 3.

FIG. 4 shows the bearing block 2 of FIG. 2 without the intermediate support and without the axial bearing 14. The holding device 25 on the brace 22 extending on the left has a reinforcement 250 by means of which the assembly of the intermediate support is facilitated. In FIG. 4 the connection 222 as already described in FIG. 3 is clearly visible. The axial distance between the two connections 221 and 222 is approximately such that a complete supporting ring bearing with one supporting ring on each end of the axle fits between them. This makes it possible to lower the intermediate support together with the assembled supporting rings in the bearing block without limitation to this action due to the design of the bearing block.

Figure 5:
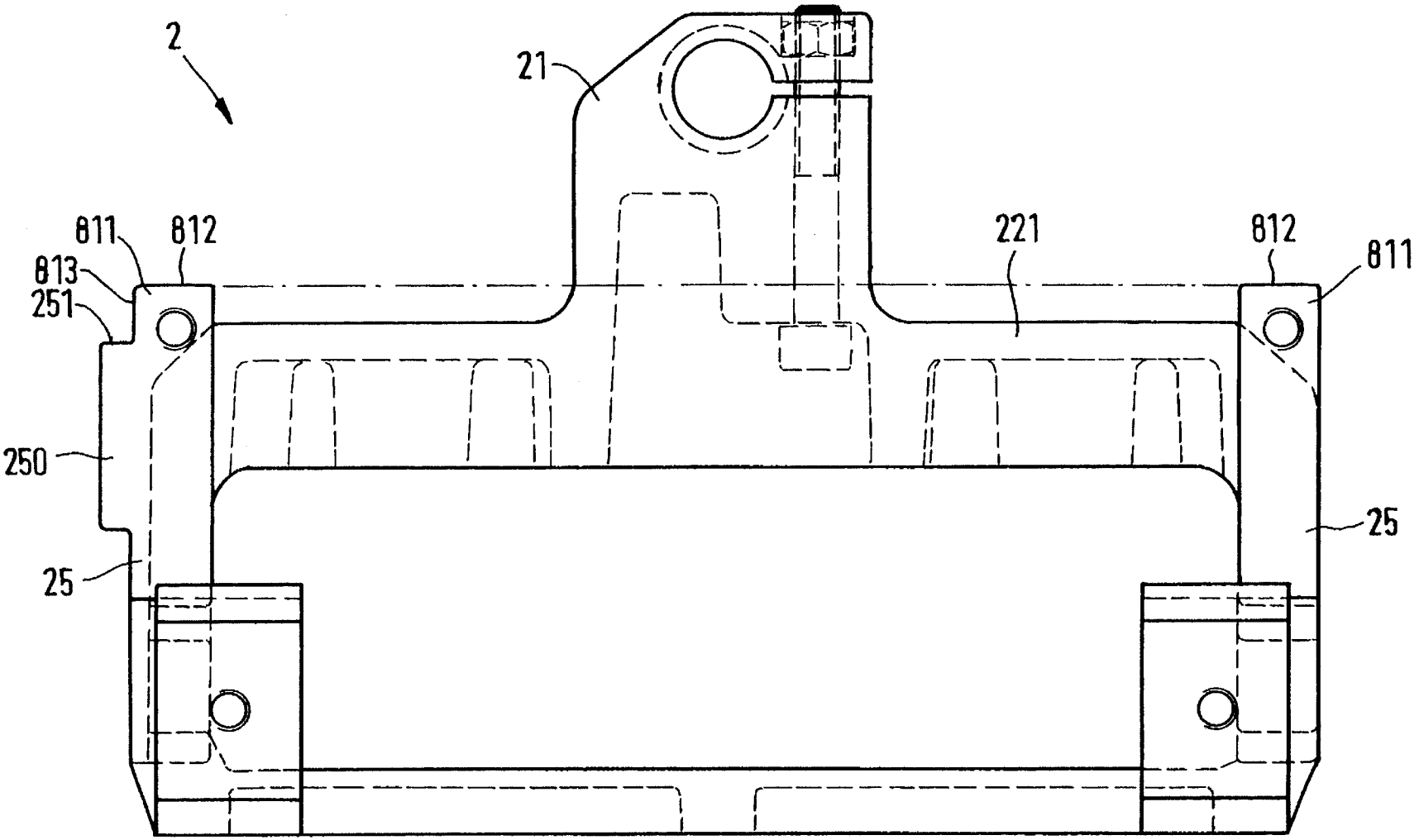
FIG. 5 shows a front view of FIG. 4.

FIG. 5 shows the bearing block 2 in a front view. The seat 21 for the axial bearing is located at the connection 221. The holding device 25 shown on the left has the reinforcement 250 which has a shoulder 251 on which the fitting surface 312 (see also FIGS. 7 and 8) of the intermediate support can be set during assembly. This serves to set the intermediate support on the left holding device 25 in the meantime so as to concentrate during assembly on the oblong opening on the right side (see also FIG. 6) and to bring it into position.

Figure 6:
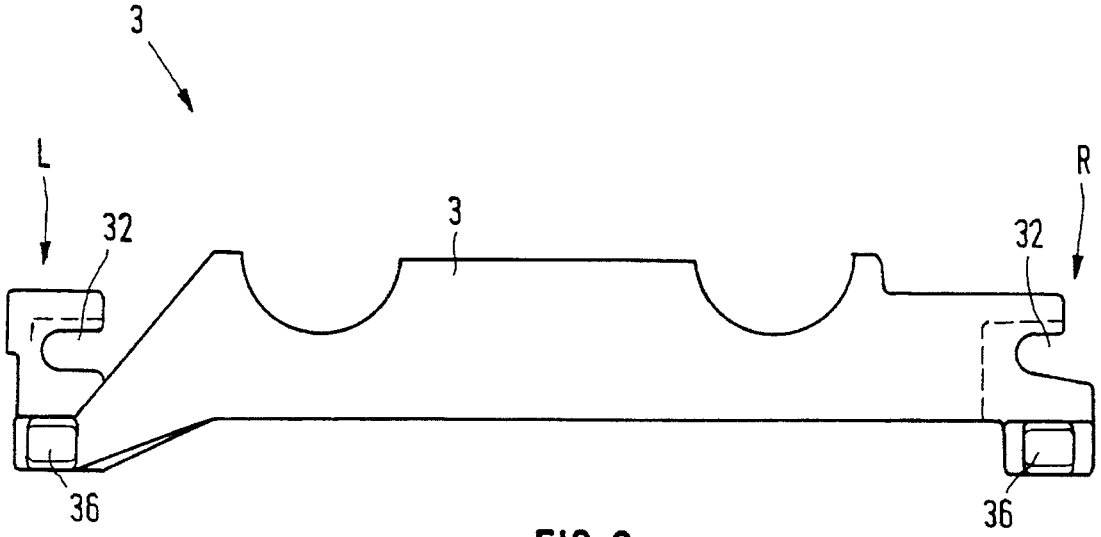
FIG. 6 shows a front view of the intermediate support of FIG. 3.
Figure 7:
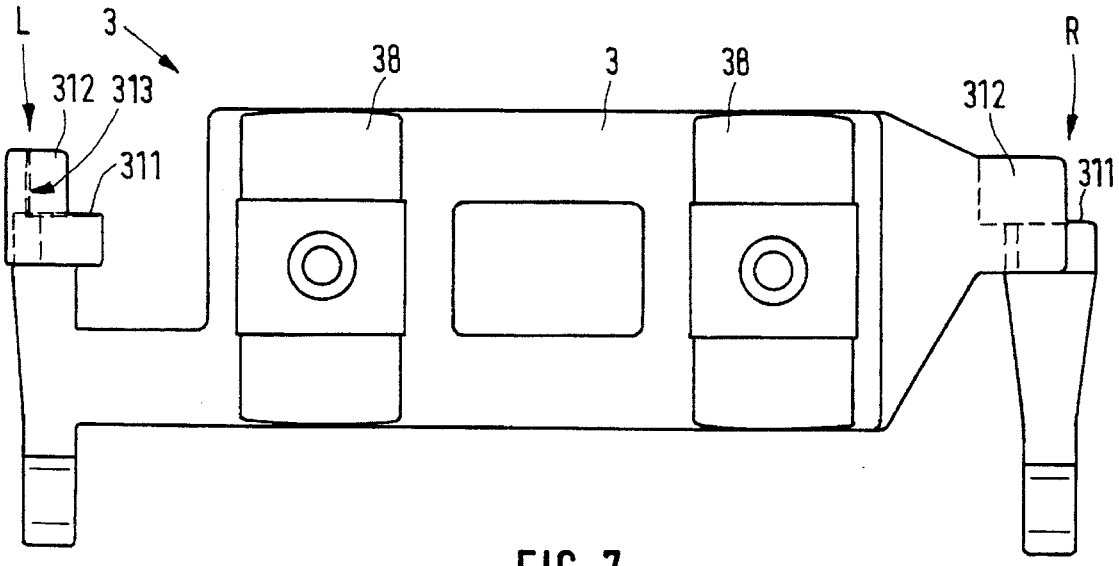
FIG. 7 shows a top view of FIG. 6.

FIG. 6 shows the front view of an intermediate support 3, such as the one shown in the bearing arrangement of FIGS. 1 to 3. The extensions 36 for the assembly implement are therefore pointing into the direction of the viewer of FIG. 6. FIG. 7 shows the intermediate support of FIG. 6 in a top view. In both drawings invisible edges are represented in part by broken lines.

The intermediate support 3 of FIG. 6 is provided on its left side with a holding device L and on the right side with a holding device R by means of which it bears on the corresponding holding devices 25 of the bearing block. As described earlier, it is attached by means of the attachments 35 which come to lie in the open oblong openings 32. The holding devices L and R have flat surfaces which are in the form of fitting surfaces by means of which the intermediate support 3 can be positioned precisely on the bearing block. With the separating plane 24 between intermediate support 3 and bearing block 2, the holding devices L and R are provided with the fitting surface 311 with which they bear upon corresponding fitting surfaces 811 of the holding devices 25 of the bearing block 2 (see also FIGS. 4 and 5). The fitting surfaces 311 of the intermediate support 3, together with their corresponding fitting surfaces 811, ensure precise alignment on the bearing block 2 of the intermediate support 3 in the axial direction which is defined by the axles of the supporting ring bearing or also by the axis of the rotor shaft. For horizontal alignment, the intermediate support 3 is provided with horizontal fitting surfaces 312 which are shown only from the back in FIG. 7 since this is a top view. The fitting surfaces 312 are bearing on their counterparts, the fitting surfaces 812 of the holding devices 25 of the bearing block 2 (see FIGS. 4 and 5). The still missing positioning of the intermediate support 3 relative to the bearing block 2 is carried out by the fitting surface 313. In FIG. 7, the fitting surface 313 is represented by a broken line since the fitting surface 313 is perpendicular to the drawing plane of FIG. 7 and is covered by the back of the fitting surface 312. The intermediate support 3 bears with the fitting surface 313 upon the corresponding fitting surface 813 on the holding device 25. Precise positioning of the intermediate support between the axially extending braces 22 of the bearing block is ensured by means of the fitting surfaces 813 and 313. Precise alignment of the nip of the supporting rings relative to the axial bearing 14 is always ensured thereby. A corresponding supporting surface does not exist on the right-side holding device R of the intermediate support 3, since fitting surfaces 313 and 813 are entirely sufficient for precise positioning. The fitting surfaces 313 and 813 are the only surfaces which must be watched by the operator during the re-installation of the intermediate support in the bearing arrangement and must be adjusted relative to each other. The fitting surfaces 312 and 812 are pressed against each other by gravity. The fitting surfaces 311 and 811 are pressed against each other by the attachment 35. The adjustment of the fitting surfaces 813 and 313 is however very simple for the operator, since the latter only needs to push the intermediate support slightly to the right while the screws 35 are tightened.

Figure 8:
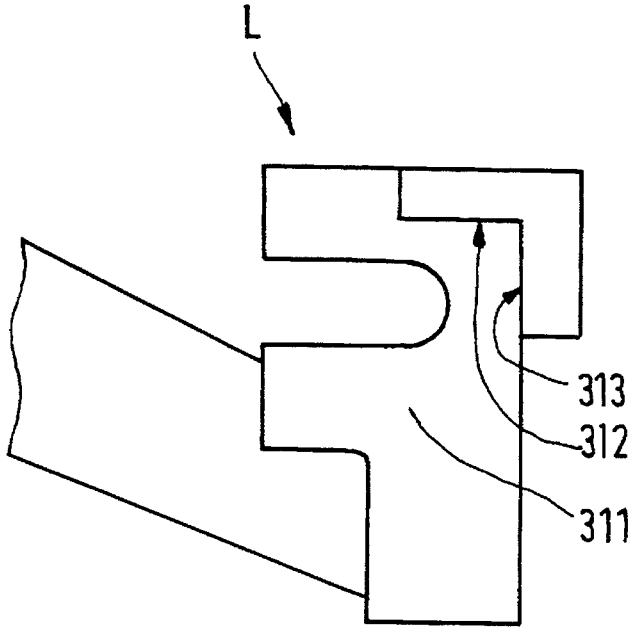
FIG. 8 shows a back view of the left holder of the intermediate support.
Figure 9:
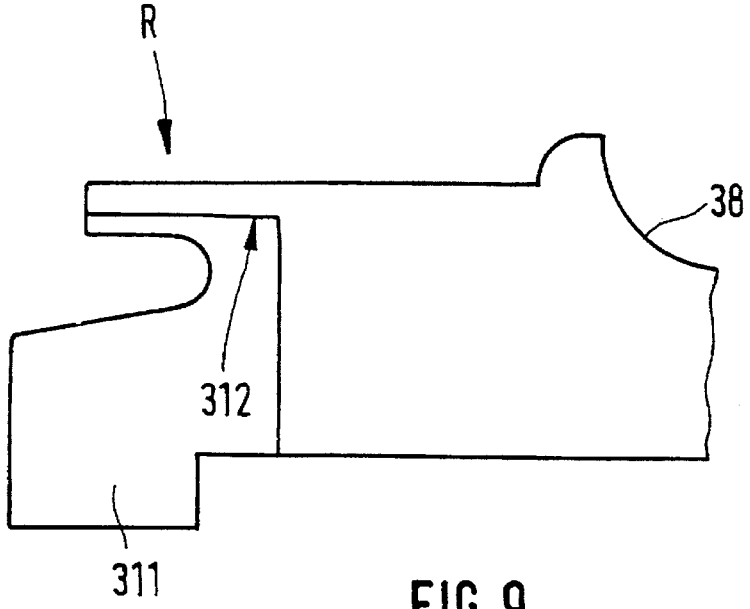
FIG. 9 shows a back view of the right holder of the intermediate support.

FIG. 8 shows the holding device L of the intermediate support 3 of FIG. 6 as seen from the back. As can be seen in FIG. 8, the fitting surfaces 311, 312 and 313 are all positioned perpendicularly relative to each other. Precise positioning is ensured by these three fitting surfaces which practically constitute stops and against which the intermediate support bears at the corresponding fitting surfaces of the bearing block when positioning said intermediate support on the bearing block. FIG. 9 shows the right-side holding device R with the fitting surfaces 311 and 312. A fitting surface 313 as with holding device L is missing.

The removal of the intermediate support proceeds as follows and is described with respect to the fitting surfaces of the bearing arrangement (see also FIGS. 3 and 6 to 9): After detaching the attachment 35, whereby it is sufficient to loosen them until the intermediate support 3 can be moved, it is pushed to the left by the operator, whereby the fitting surfaces 312 and 812 slide on top of each other and the fitting surfaces 313 and 811 distance themselves from each other. The fitting surfaces 311 and 811 also slide on top of each other. The shifting movement to the left moves the attachment 35 out of range of the open oblong holes 32 of the holding devices L and R. Thereupon the intermediate support 3 can be moved down and in the direction away from the axial bearing. The downward movement increases the distance o the driving means. The intermediate support 3 is then located in the area of the free space 23 (see also FIG. 23). In this area, it can now be moved on, in particular forward, whereby the pair of supporting rings towards the axial bearing is located below the driving means 15 (see also FIG. 2). By tilting the intermediate support, the distance can be further increased and the intermediate support can be guided out with the supporting rings from the bearing arrangement without contact with the other components of the bearing arrangement, in particular with the still running tangential belt 15.

In particular when the bearing support 161 is a continuous rod, it is especially advantageous for the dimensions of the supporting rings to be selected so that the distance between the driving means and the bearing support is greater than the diameter of the supporting rings. The supporting rings can be used to special advantage in the bearing arrangement according to the invention if their diameter lies within the range from 60 mm to 90 mm, and even preferably between 69 mm and 79 mm, because thereby the bearing arrangement can be made compact overall.

It will be apparent to those skilled in the art that various modifications and variations can be made in the present invention without departing from the scope or spirit of the invention. For example, features illustrated or described as part of one embodiment can be used with another embodiment to yield a still further embodiment. It is intended that the present invention cover such modifications and variations as come within the scope of the appended claims and their equivalents.

I claim:

1. A bearing arrangement for an open-end spinning machine having a machine frame wherein a spinning rotor with a shaft is supported in the nip of rearward and forward supporting rings which are mounted on shafts and supported by supporting ring bearings, the spinning rotor being driven by drive means in the area between the supporting rings, said bearing arrangement comprising:

a bearing block attached to bearing supports defined on a machine frame of the open-end spinning machine, said bearing block comprising spaced apart braces which extend axially relative to said supporting ring bearings, said braces defining an open space therebetween;

a seat defined in said bearing block for receipt of an axial bearing for said spinning rotor;

an intermediate support structure member removably attached to said bearing block, said intermediate support structure supporting said supporting ring bearings, said intermediate support structure disposed above said open space between said braces; and wherein said intermediate support structure is removable from said bearing block with said supporting ring bearings while said bearing block remains attached to said machine frame through said bearing supports by lowering said intermediate support structure into said open space between said braces.

2. The device as in claim 1, wherein said braces support said axial bearing seat.

3. The device as in claim 2, wherein said braces define a distance therealong wherein no element connects said braces over a distance at least equal to the length of said supporting ring shafts.

4. The device as in claim 3, wherein said braces are at a distance from each other which is equal to approximately twice the diameter of said supporting rings.

5. The device as in claim 1, further comprising a separation plane defined between said intermediate support structure and said bearing block, said separation plane being essentially perpendicular to an axes of said supporting ring bearings.

6. The device as in claim 5, wherein said separation plane lies in a vertical plane disposed between said rearward and forward supporting rings.

7. The device as in claim 5, wherein said intermediate support structure is movable in a horizontal plane with respect to said bearing block in a direction essentially at a right angle to said axes of said supporting ring bearings.

8. The device as in claim 5, wherein said intermediate support structure is movable in a vertical plane with respect to said bearing block in a direction essentially at a right angle to said axes of said supporting ring bearings.

9. The device as in claim 1, wherein said intermediate support structure further comprises a plurality of fitting surfaces and said bearing block comprises a plurality of matching fitting surfaces engaging said intermediate support structure fitting surfaces for precise alignment of said intermediate support structure relative said bearing block.

10. The device as in claim 9, wherein at least two of said intermediate support structure fitting surfaces and respective said matching bearing block fitting surfaces are disposed in two different planes.

11. The device as in claim 10, wherein said planes are essentially perpendicular to each other.

12. The device as in claim 10, wherein said intermediate support structure fitting surfaces and respective said matching bearing block fitting surfaces are disposed to allow for horizontal and vertical movement of said intermediate support structure with respect to axes of said supporting ring bearings.

13. The device as in claim 1, further comprising an axial bearing disposed in said axial bearing seat, said intermediate support structure attached to said bearing block and removable from said bearing block independently of said axial bearing.

14. The device as in claim 13, wherein said axial bearing seat is defined in said bearing block.

15. The device as in claim 11, wherein said intermediate support further comprises an extension for receipt of an assembly implement device.

16. An open-end spinning machine, comprising:

a machine frame;

a bearing block attached to bearing supports defined on said machine frame, said bearing block comprising spaced apart braces which extend axially relative to said supporting ring bearings, said braces defining an open space therebetween;

an intermediate support structure member removably attached to said bearing block, said intermediate support structure disposed above said open space between said braces;

pairs of supporting rings mounted on shafts and supported by supporting ring bearings, said intermediate support structure supporting said supporting ring bearings;

a spinning rotor with a shaft supported in the nip of rearward and forward supporting rings of said pairs of support rings;

drive means for driving said spinning rotor in the area between said supporting rings; and wherein said intermediate support structure is removable from said bearing block with said supporting ring bearings while said bearing block remains attached to said machine frame through said bearing supports by lowering said intermediate support structure into said open space between said braces.

* * * * *